United States Patent [19]

Tsen et al.

[11] 4,178,714

[45] Dec. 18, 1979

[54] LIGHTED AND SOUNDING TOY

[76] Inventors: John B. Tsen; Fan B. Tsen, both of 7700 Clark La., Manlius, N.Y. 13104

[21] Appl. No.: 920,010

[22] Filed: Jun. 28, 1978

[51] Int. Cl.[2] ..... H01H 35/02; A63H 33/26; A63H 27/12

[52] U.S. Cl. ..... 46/228; 46/227; 46/61; 200/61.48

[58] Field of Search ..... 46/227, 228, 60, 63, 46/232; 200/80 B, 80 R, 276, 61.48, 61.52, 61.49

[56] References Cited

U.S. PATENT DOCUMENTS

| | | | |
|---|---|---|---|
| 2,623,327 | 12/1952 | Testino | 46/228 |
| 2,705,267 | 3/1955 | La Rosa | 200/61.49 |
| 3,002,062 | 9/1961 | Globe | 200/61.48 |
| 3,162,979 | 12/1964 | Garoogian | 46/228 |
| 3,191,344 | 6/1965 | Yagjian | 46/228 |
| 3,531,892 | 10/1970 | Pearce | 46/228 |
| 3,631,804 | 1/1972 | Anderson | 200/61.48 |
| 3,731,022 | 5/1973 | Loftus | 200/61.49 |
| 3,798,834 | 3/1974 | Samuel | 46/228 |
| 3,924,114 | 12/1975 | Sanchez | 46/228 |
| 4,080,753 | 3/1978 | Hiner et al. | 46/227 |

*Primary Examiner*—Louis G. Mancene
*Assistant Examiner*—Michael J. Foycik

[57] ABSTRACT

A lighted and sounding yo-yo is provided with a single heavy duty battery in a first hollow shell section, and a lamp in both hollow shell sections. Flexible electrical conductors connect the lamps to the battery. A centrifugal switch is joined with the conductors in the second shell section so as to actuate the lamps only during rotation of the yo-yo. An audible electrical signal device is also located in the lighting circuit of the second shell. A second modification of the centrifugal switch is also shown. The heavy weight of the battery shell as compared with the light weight of the other shell causes the battery shell to dominate the yo-yo in the manner of a gyroscopic action to obtain rotational stability.

9 Claims, 7 Drawing Figures

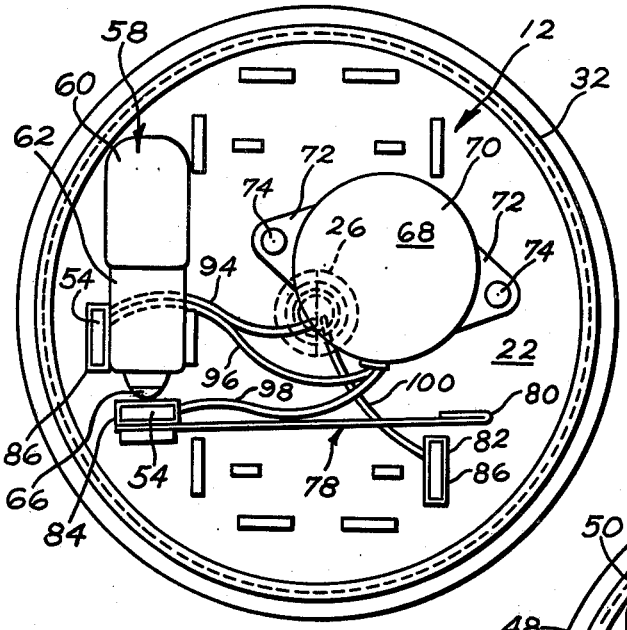
FIG. 4
FIG. 3
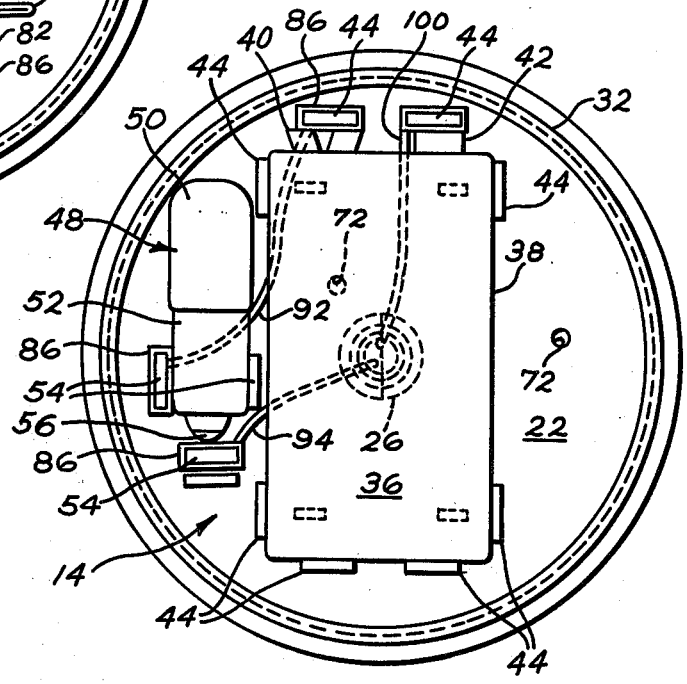
FIG. 8
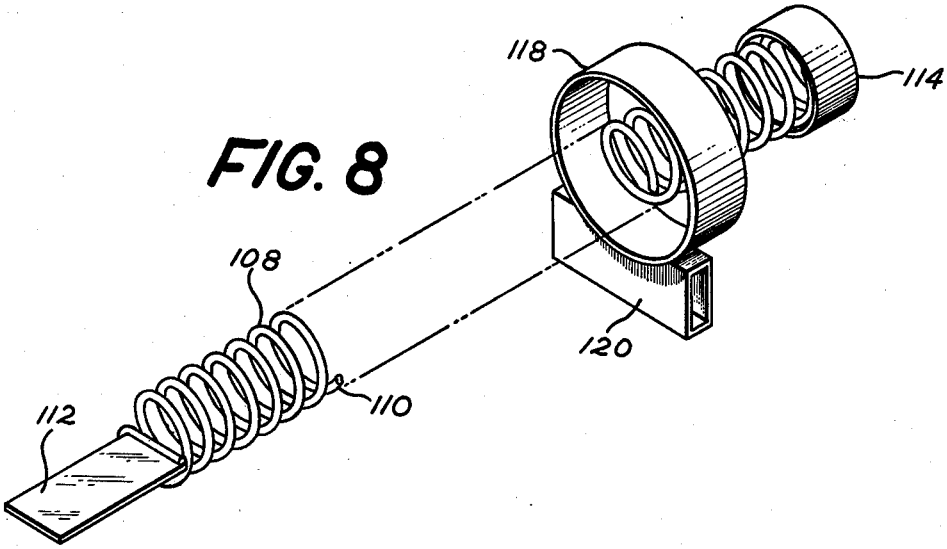

LIGHTED AND SOUNDING TOY

BACKGROUND OF THE INVENTION

1. Field of the Invention

This invention relates to lighted toys, and particularly to toys such as yo-yos and the like that move, vibrate or revolve in use such that a centrifugal switch will energize the lights only when the toy is in motion.

2. Description of the Prior Art

Lighted yo-yos with centrifugal switches are known in the prior art. There is an expired Testino U.S. Pat. No. 2,623,327. It has a single battery which is supported in the hollow axle of the yo-yo. There is a single lamp on each side of the yo-yo. There is a single-pole, double-throw, centrifugal switch which closes in a first position when the yo-yo turns in one direction to light the lamps. The switch closes in a second position when the yo-yo turns in the opposite direction to light the lamps. The switch mechanism and circuit conductors take up a large amount of the space within the yo-yo.

The Garoogian U.S. Pat. No. 3,162,979 shows a lighted yo-yo having a battery and a lamp on each side of the yo-yo. There is also a centrifugal switch with a U-shaped fixed contact member. This patent has three modifications of the centrifugal switch. This yo-yo has a solid axle.

The Yagjian U.S. Pat. No. 3,191,344 also shows a lighted yo-yo with a battery and a lamp on each side of the yo-yo. Each lamp is supported on the free end of a cantilever spring that serves as a centrifugal switch member. Each shell of the yo-yo has a plurality of pins for supporting the electrical conductors with respect to the battery and to the lamp.

Another lighted yo-yo design of minimum parts is shown in the Sanchez U.S. Pat. No. 3,924,114 which also has a battery and lamp on each side of the yo-yo. One conductive strip from the battery cooperates with the base of the lamp to serve as a centrifugal switch.

OBJECTS OF THE PRESENT INVENTION

The principal object of the present invention is to provide a lighted yo-yo with an audible electrical signal and a heavy duty power source.

A further object of the present invention is to provide a yo-yo with a combined lighting system and audible electrical signal which are actuated only during rapid rotation of the yo-yo.

A further object of the present invention is to provide a yo-yo of the class described wherein the yo-yo has an unsymmetrical weight distribution wherein the heavy side overpowers the light side and thus controls the rotational stability of the device.

A further object of the present invention is to provide a second modification of the centrifugal switch for a lighted toy where the switch has, in addition to centrifugal action, a high frequency vibration action to provide a blinking effect.

A further object of the present invention is to provide a lighted and sounding yo-yo with improved electrical connections to increase the expected operating life of the device.

SUMMARY OF THE INVENTION

The present invention provides a lighted yo-yo with an audible electrical signal device and a single heavy duty battery power source. The battery is centered within a first hollow shell section, and there is a lamp in both hollow shell sections. A centrifugal switch and an audible electrical signal device is located within the second shell section. The weight distribution of the yo-yo is purposely not symmetrical so the heavy side of the yo-yo is capable of overpowering the light side of the yo-yo and thus control the rotational stability of the device.

BRIEF DESCRIPTION OF THE DRAWINGS

This invention will be better understood from the following description taken in conjunction with the accompanying drawings and its scope will be pointed out in the appended claims.

FIG. 3 is a right side view of the yo-yo shown in FIG. 2 with the cover removed to show the heavy duty battery that is centrally located in the hollow shell, and a lamp positioned at one side of the battery and joined to the battery by insulated wires, FIG. 4 is a left side view of the yo-yo shown in FIG. 2 showing again the hollow axle portion, an audible electrical signal device located off-center of this second hollow shell section, and another lamp positioned at one side of the shell section, as well as a centrifugal switch which is normally open and is biased closed by the rotational force of the yo-yo in motion.

FIG. 8 is an exploded view of a second modification of a centrifugal switch for a lighted toy or the like, where the movable switch member is a very light helical spring that is mounted in cantilever style, and it cooperates with an oversized ring member as a fixed contact so it is capable of vibrating about its longitudinal axis at a high frequency to produce a rapid blinking light and sound effect.

DESCRIPTION OF THE PREFERRED EMBODIMENTS

Figure 1:
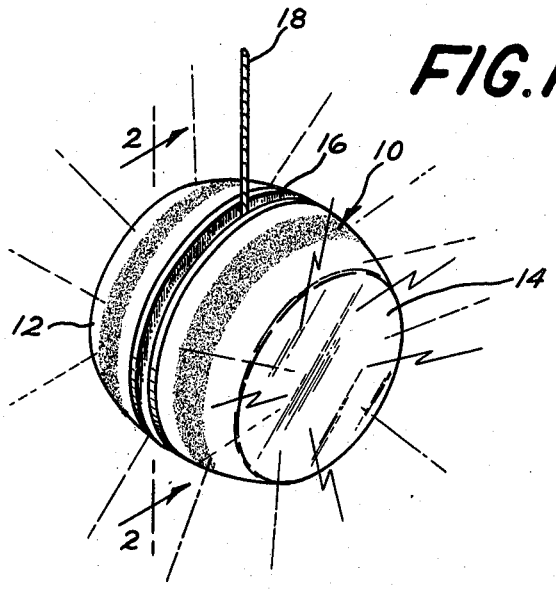
FIG. 1 is a perspective view of a lighted and sounding yo-yo embodying the present invention, which yo-yo is constructed mainly of a translucent or transparent molded plastic material.
Figure 2:
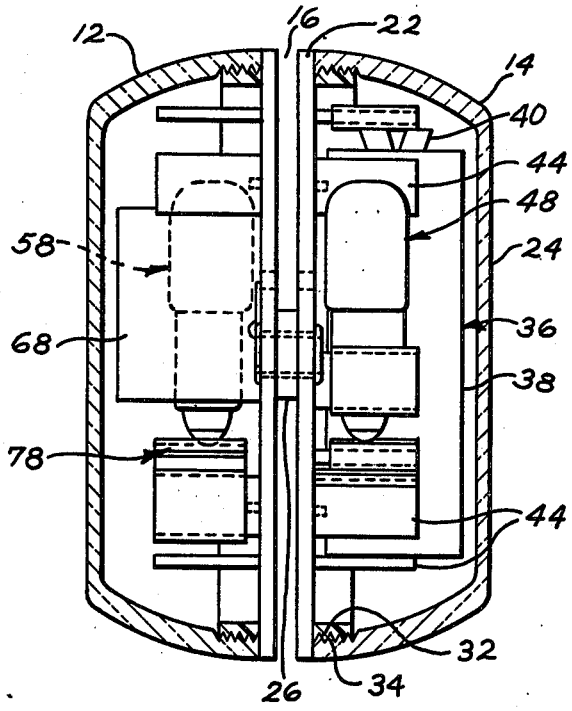
FIG. 2 is a transverse cross-sectional elevational view of the yo-yo taken on the line 2—2 of FIG. 1, showing a hollow axle portion.
Figure 5:
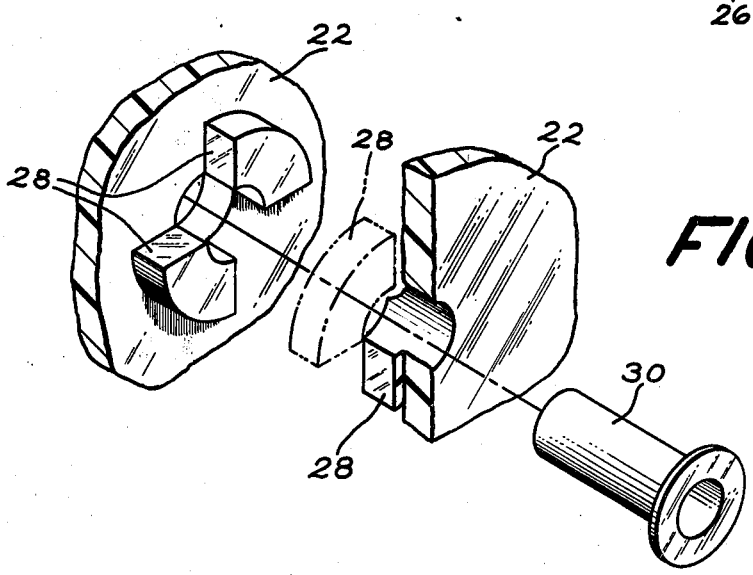
FIG. 5 is an exploded fragmentary view in the area of the hollow axle portion of the yo-yo.

Turning now to a consideration of the drawings and, in particular, to the overall perspective view of FIG. 1, there is shown a yo-yo 10 that has two hollow shell sections 12 and 14 respectively that are separated by a narrow groove 16 in which a string or cord 18 operates, as is well understood in this art The nature of the yo-yo 10 is better understood with relation to the cross-sectional view of FIG. 2. Each hollow shell section 12 and 14 is formed of two identical parts; namely a base plate 22 and a bowl-shaped removable cover 24. The lighting and sounding components are shown mounted to the base plate, but those who are skilled in this art will readily appreciate that this order could be reversed without departing from the present invention. In other words, the base plate could be of bowl-shape, and the cover could be a flat plate at the side of the yo-yo.

This yo-yo 10 has a hollow axle portion 26 that joins the two shells 12 and 14 together. The outer side of each base plate 22 has a pair of diagonally opposite quarter circle hub portions 28 which interlock with those of the other base to form a hollow cylindrical hub or axle portion 26. A hollow rivet 30 is adapted to slip through the axle portion and to be riveted in place for holding the two base plates assembled together, but separated by the groove 16.

The yo-yo string 18 is to be looped around the axle portion 26 and the ends are to be twisted together and then tied together at their ends so a persons finger may be engaged therein.

The inner side of each base plate 22 has a threaded peripheral portion 32 for engagement with internal threads 34 near the free edge of the cover 24. Hence each cover 24 is held to its base plate 22 by turning the cover to screw the cover onto the base plate. A reverse turning action will remove the cover from the base plate.

Now turning to a consideration of FIG. 3, there is shown a heavy duty battery 36 which is a 9 volt transistor radio battery having a rectangular shaped body 38 with a pair of battery terminals 40, 42 at the top portion. A series of eight posts 44 are molded onto the base 22 to receive the battery 36 therebetween with a slip fit for confining the battery in place against any sidewise motion. When the removable cover 24 is fastened to the base plate 22, as is shown in FIG. 2, the battery 36 cannot slip away from the posts 44. Notice the battery 36 is shown centered over the central axle portion 26. As an alternative, this 9 volt battery 36 could be replaced by two side-by-side pen light batteries (not shown).

Arranged at the side of the battery 36 is a miniature lamp 48 having a glass bulb 50 and metal base 52. Three posts 54, which are similar to posts 44, are molded to the base 22 to receive the base end of the lamp 48 therebetween. The lamp 48 has a first tip contact 56, and the metal base 52 serves as the second lamp contact. One of the three posts 54 cooperates with the tip contact 56, and the two remaining posts 54 are positioned in parallel to engage the opposite side of the lamp base 52. The glass bulb of the lamp is sandwiched between a post 44 and the threaded portion 32 of the base 22.

Before discussing the electrical connections, a description will be given of the left hand shell 12 that is shown in FIG. 4. As stated earlier, both shell sections 12 and 14 are formed of identical parts, base 22 and cover 24. Thus, the posts 54 are available for receiving a second miniature lamp 58 having a glass bulb 60, metal base 62 and tip contact 66, in a manner the same as lamp 48.

An audible electrical signal device 68 in the form of a "beeper", as is widely used in current smoke alarm devices, is fastened to the base 22 in an off-center position. The beeper 68 has a cylindrical body 70 and a pair of mounting ears 72. A pair of spaced plastic pins 74 fit into mating holes in the mounting ears 72. The pins are touched with a hot iron (not shown) to soften and flatten the head of the pins and lock the beeper in place. The beeper 68 is shown slightly off-center of the axle portion 26, and it is of light weight as compared with the weight of the 9 volt transistor radio battery 36. Thus, in operation, the rotation of the heavy weight battery shell 14 dominates the rotation of the light weight beeper shell 12 in the manner of a gyroscopic action. The weights of the two lamps 48 and 58 can be ignored in the calculation of the rotational forces in the two shells because they are equal and opposite, and thus cancel each other out.

A normally open centrifugal switch 78 is also shown in FIG. 4. It has a movable cantilever spring contact blade 80 and a fixed contact 82. The fixed end of the cantilever spring blade has an integral spring clip 84 which slips down, with a tight fit, over the post 54 which is nearest the lamp tip contact 66. The fixed contact 82 is represented by a metal clip 86 which slips down, with a tight fit, over a post 44, which is adjacent the opposite edge of the base 22. The free end of the blade 80 may be folded back on itself, as at 88, to add some extra weight to improve the centrifugal action of the blade 80 during rotation of the yo-yo.

Insulated stranded wire conductors are used as circuit conductors to join all of the electrical components together in a series circuit that is controlled by the centrifugal switch 78. One wire 92 joins one terminal of the battery to the post 54 adjacent the lamp base 52. The ends of the wire would be stripped of insulation and draped over the posts 44 and 54, A metal clip 86 would be forced down over the post and wire to make a good electrical connection and to serve as a fixed contact member. Another wire 94 extends from the post 54 adjacent the lamp tip contact 56, under the battery 36, through the hollow axle portion 26, and then joined to the post 54 adjacent the lamp base 62. The beeper 68 has two leads 96 and 98 for connecting the beeper in parallel with the lamp 58. A wire 100 connects the fixed contact 82 of the centrifugal switch with the other battery terminal by first passing out of the second shell, through the hollow axle.

Figure 7:
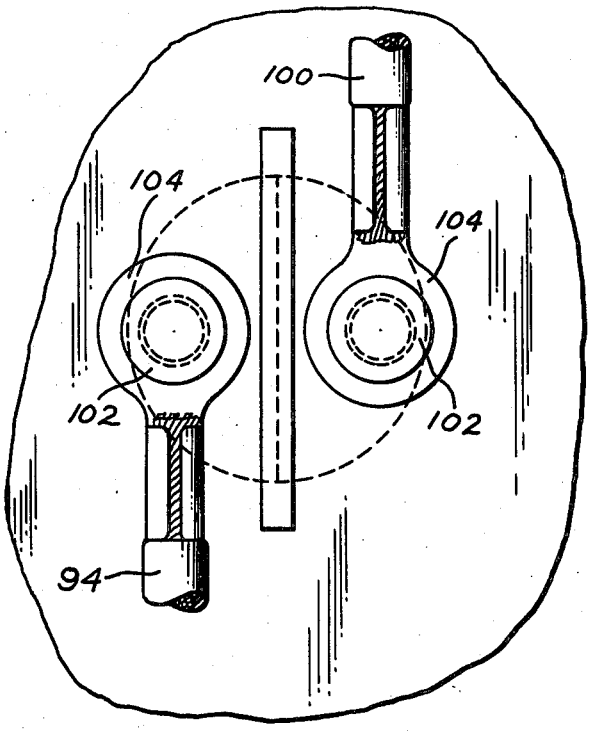
FIG. 7 is a top plan view of FIG. 6 showing tab terminals fastened to the wire conductors and joined to the two fastener members.
Figure 6:
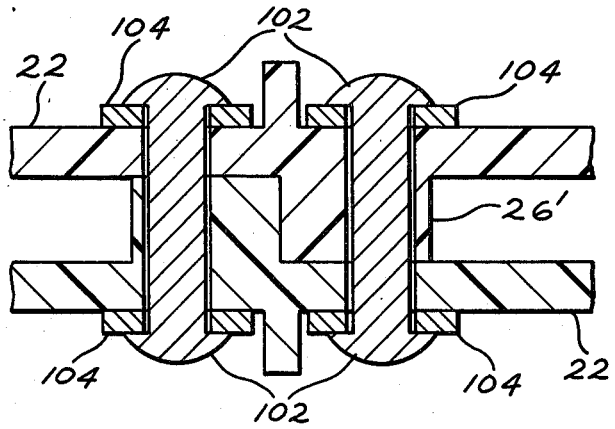
FIG. 6 is a fragmentary view of a second modification of the axle portion of the yo-yo showing a solid axle with a pair of current-carrying fastener members.

FIG. 6 and 7 show a second modification of the axle portion 26. FIG. 6 has a solid axle portion 26' with two axially split hub portions 104. A pair of small rivets 102 extend through the axle portion for joining the two base plates 22, 22 together. Wires 94 and 100 are each provided with a tab terminal 104 for fastening the wires to the rivets.

FIG. 8 shows a second modification 108 of a centrifugal switch to replace the switch 78. This switch has a movable contact 110 in the form of a light helical spring having a mounting tab 112 at its fixed end and an added weight 114 at its free end to improve its vibrating action. A fixed switch contact 116 is in the form of an oversized ring 118 through which the spring extends in a spaced relation during an at-rest condition. The ring has a mounting sleeve 120 for engagement on a post member (not shown). The helical spring 110 is a current-carrying member and it is capable of flexing in all transverse directions measured from the longitudinal axis of the spring to create a high frequency blinking or alternating light and sound effect.

Modification of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A lighted yo-yo comprising a pair of hollow shell sections each having a removable cover and formed of translucent material and joined together by an axle portion to define a central groove for receiving an elongated string that is attached to the axle portion, and lighting means to produce a source of light for each shell section, said lighting means comprising heavy duty battery means in one shell section and a lamp in each shell section, and electrical conductors connecting the battery means to the lamps, and centrifugal switch means in one conductor whereby when the yo-yo is rotating the switch will be biased closed to energize the lamps; the invention comprising locating the battery means in a first shell section with its central portion adjacent the central axis of the axle portion, while the second shell section is provided with a light weight audible electrical signal device that is electrically connected in the lighting means circuit to function simultaneously with the lamps, the relative heavy weight of the battery means versus the light weight of the audible signal device creating an unbalanced condition, whereby the heavy side dominates the light side and controls the rotational stability of the yo-yo.

2. The invention of claim 1, wherein the said audible electrical signal device is a beeper, and the said centrifugal switch means is located within the second shell section.

3. The invention of claim 2 wherein the said battery means is a heavy duty battery of about 9 volts and thus the battery shell section is greatly overweight as compared with the audible signal shell section so that the heavy side dominates the light side and thus controls the rotational stability of the yo-yo in the manner of a gyroscopic action.

4. The invention of claim 1 wherein the said electrical conductors include flexible insulated conductors, some of which conductors extend through a hollow axle portion of the yo-yo.

5. The invention of claim 4 wherein the said centrigual switch means is located within the said second shell means, and the said audible electrical signal device is a beeper, and a hollow rivet member extends through the hollow axle portion and assembles the two shell sections together.

6. The invention of claim 1 wherein the said electrical conductors include flexible insulated conductors, and a pair of fastener members extending through the axle portion for joining the two shell sections, the electrical circuit being carried from one shell section to the other by means of the said pair of fasteners.

7. The invention of claim 1 wherein each shell section is provided with a plurality of posts which serve to confine the battery and lamps in place, the said electrical conductors comprising at least some flexible wire members are joined to the posts by metal clip members, said clip members also serving to make electrical connection with the nearest battery or lamp members.

8. The invention of claim 7 wherein the clip members are ring members that slip down over the post to capture the wire member thereby, the clip member also serving as a fixed electrical contact member with relation to the electrical components of the device.

9. The invention of claim 2 wherein the said centrifugal switch comprises a movable cantilever member and a fixed contact member, the cantilever member including a light weight helical spring with an added weight at its free end, the fixed contact member including an oversized ring member through which the helical spring extends in a spaced relation when in a normal at-rest position, whereby the helical spring is capable of flexing in all transverse directions measured from its longitudinal axis, so as to vibrate at a high frequency with respect to the ring contact to create an alternating light and sound effect.

* * * * *